United States Patent [19]

Hickman

[11] 4,203,244

[45] May 20, 1980

[54] GUNSTOCK ELEVATOR ATTACHMENT

[76] Inventor: Jack L. Hickman, 1809 Plaza Way, Walla Walla, Wash. 99362

[21] Appl. No.: 925,101

[22] Filed: Jul. 17, 1978

[51] Int. Cl.[2] ..... F41C 23/00

[52] U.S. Cl. ..... 42/73

[58] Field of Search ..... 42/73, 72, 74, 71 R

[56] References Cited

U.S. PATENT DOCUMENTS

| | | | |
|---|---|---|---|
| 56,506 | 7/1866 | Jones | 42/73 |
| 1,088,362 | 2/1914 | Perkins | 42/73 |
| 1,582,395 | 4/1926 | Haemmerli | 42/73 |
| 1,847,777 | 3/1932 | Morgan | 42/73 |
| 2,066,218 | 12/1936 | Morgan | 42/73 |
| 2,787,855 | 4/1957 | Guymon | 42/73 |
| 3,710,496 | 1/1973 | Packmayr | 42/73 |
| 4,055,016 | 10/1977 | Katsenes | 42/73 |
| 4,122,623 | 10/1978 | Stice | 42/73 |

OTHER PUBLICATIONS

*Trap & Field,* p. 7, Jan. 1978.

*Primary Examiner*—Charles T. Jordan

*Attorney, Agent, or Firm*—Wells, St. John & Roberts

[57] ABSTRACT

An attachment is disclosed that functions to elevate a shooter's line of sight above the barrel of a rifle or shotgun to both improve the position of the shooter's head and to reduce the effects of recoil. The stock elevating attachment is adjustably mounted to the gunstock. It includes a recoil absorbing pad and a forwardly extending stock elevator that is smoothly rounded to fit the shooter's cheek. A set screw provided with the elevating assembly enables adjustment of the stock elevator and recoil absorbing pad relative to the associated gunstock. The attachment is mountable to a variety of different firearms and can be mounted to and removed from such gunstocks without requiring permanent stock modifications.

8 Claims, 6 Drawing Figures

4
2
66
68
56
53
50
18
67
16
65
51
52
19
64
58
51
41a
3
3
17
15
2
63
4

67
53
54
52
60
57
58

65
41a
57
62
60
52
58

67
53
54
51
58
57
51

55

52
58
15
65
57
60

GUNSTOCK ELEVATOR ATTACHMENT

BACKGROUND OF THE INVENTION

The present invention relates to stock elevating attachments for rifles and shotguns.

Shotguns and rifles typically have a hardwood stock that extends from the receiver rearwardly to a butt or shoulder plate. The stock includes a forward narrow hand grip section rearwardly adjacent the receiver and a vertically flaring cheek piece rearward of the hand grip. Atop the cheek piece is a rounded "comb" upon which the shooter rests his cheek while aiming and firing the weapon.

The physical characteristics of shooters vary substantially. It follows that some shooters will find the comb of some firearms more comfortable than others. Aside from comfort, it is very important that the shooter keep his head in as nearly an upright posture as possible in order to maximize his field of vision and to decrease the time required to come to a shooting position. This is vitally important to trapshooters who must respond almost instantaneously to fast flying "clay pigeons" in order to score well. The sooner the shooter sees his target and get settled in a comfortable firing position, the more time he has to take proper aim and fire.

Shotguns utilized in trapshooting are often specially designed with a comb that is relatively close to the elevation of the gun barrel. Field guns have angular combs that are spaced horizontally below the gun barrel. It follows that an attachment that is to be utilized for elevating the stock toward the gun barrel must be selectively adjustable if it is to fit different forms of shotguns and rifles. It therefore becomes desirable to obtain a universal elevator attachment.

It is desirable to elevate the line of sight as discussed above to improve the shooter's field of vision. It is also desirable to lower the line of recoil impact more toward the center of mass of the shooter. The effect of the recoil may therefore be reduced and is felt as a significantly lighter jolt. Since the line of recoil force is produced at a lower station, a resultant force is produced that causes the muzzle end of the firearm to substantially retain its elevational position rather than lift upwardly upon discharge.

Conventional attachments have been produced that change the elevation of a rifle or shotgun butt plate. They typically include an adjustable recoil pad or an integral, elevationally adjustable comb piece formed into the stock. The adjustable combs are carried on upright rods that are fitted to the stock forward of the butt plate. Obviously, it is necessary to alter the stock to mount the elevator piece. The alteration leaves the gunstock permanently disfigured. Therefore, the attachment must become a permanent fixture on the gunstock or the gunstock must be completely replaced when it is desired to remove the attachment. It therefore becomes desirable to obtain a combined stock elevator and recoil pad attachment that will mount to existing gunstocks without requiring any visible alterations.

DETAILED DESCRIPTION OF A PREFERRED EMBODIMENT

Figures 1, 2, 3, 4, 5, 6:
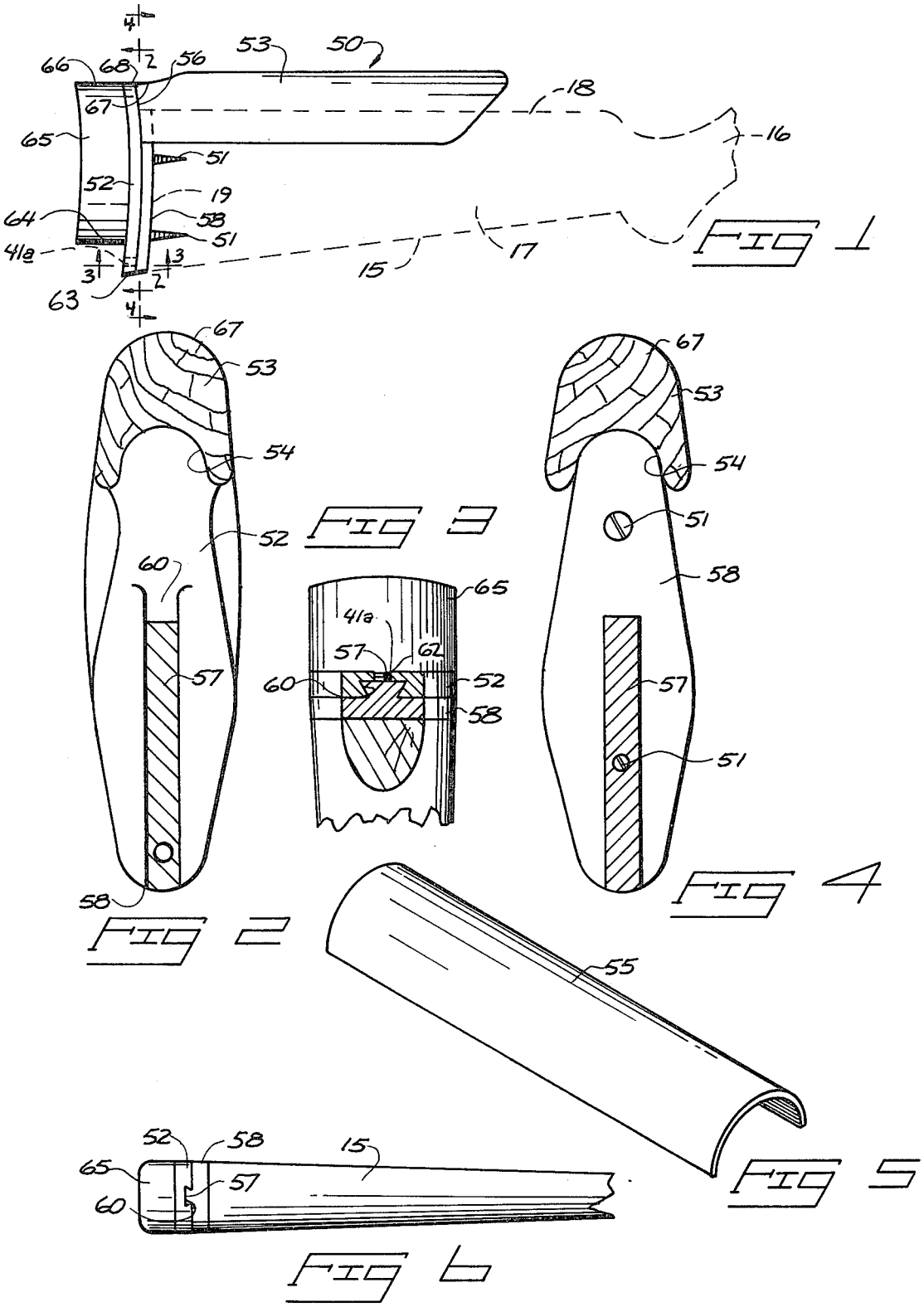
FIG. 1 is an enlarged detail view of the present elevator attachment.
FIG. 2 is an enlarged sectional view taken along line 2—2 in FIG. 1.
FIG. 3 is an enlarged fragmentary sectional view taken along line 3—3 in FIG. 1.
FIG. 4 is an enlarged sectional view taken along line 4—4 in FIG. 1.
FIG. 5 is a pictorial view of a shim utilized with the present invention.
FIG. 6 is a bottom plan view as seen from below in FIG. 1.

FIG. 1 of the drawings illustrates the present attachment mounted to a stock 15 of a shotgun or rifle. The stock 15 includes a forward portion of reduced cross section that defines a hand grip 16. The stock flares vertically and rearwardly from the hand grip 16 forming a cheek piece 17 that extends to a butt plate 19. The upper ridge of the cheek piece 17 is termed a "comb" 18. Forms of shotguns utilized for trapshooting have a comb 18 that is close to the horizontal and is elevationally spaced close to the horizontal plane of the associated gun barrel. Conversely, shotguns that are utilized for game shooting and some rifles have barrels that are elevated somewhat from the comb and the comb itself is situated at more of an oblique angle to the plane of the barrel. The angular relationship of comb to barrel varies also between different types of rifles.

The below described attachment is universally adaptable for various forms and configurations of rifles and shotguns, some significantly different from the example illustrated in FIG. 1. The attachment is provided for the purpose of elevating the shooter's head and lowering the line of recoil impact.

The present stock elevator attachment is illustrated generally at 50 in FIG. 1. The attachment includes a mounting means that is provided to adjustably and inconspicuously mount the attachment to the gun stock butt plate 19.

The mounting means partially includes an adaptor plate 58 and wood screws 51 that extend through the plates 58 to threadably engage the stock material at butt plate 19. The adaptor plate 58 includes an upright rib 57 which is received by a complementary slot 60 formed in a recoil plate 52. The recoil plate 52 rigidly mounts a forward projecting stock elevator member 53.

The position of screws 51 is such that no visible means of attachment will be seen along the gunstock. The screws 51 are imbedded within the stock at a position where a conventional butt plate cover (not shown) is normally fitted. Therefore, the stock will not be marred or altered by mounting of the present attachment 50. The screws 51 allow the attachment 50 to be removed and the associated firearm returned easily and conveniently to its original configuration by replacing the original butt plate cover.

The stock elevator member 53 is preferably constructed of hardwood such as walnut or hickory, selected to closely match the shade and grain pattern of the associated gunstock 15. The elevator member 53 includes a concave comb receiving surface 54 that is complementary in cross section (FIGS. 2 and 4) to the comb 18. Surface 54 allows the elevator member 53 to rest snugly against the comb 18. FIG. 5 illustrates a shim 55 that may be placed between the concave surface 54 and comb 18 to prevent scuffing of the stock comb surface against surface 54. Shim 55 may also be used alone or in multiples to facilitate elevational adjustment of the stock elevator 53 relative to the gunstock 15.

An end 56 of the stock elevator member 53 is rigidly affixed to the recoil plate 52. It will therefore move up or downwardly as the plate is moved relative to the gunstock. Standard fastening mechanisms such as screws, bolts, possibly in combination with glue, may be utilized to rigidly affix the plate 52 to the elevator member 53.

The configuration of recoil plate 52 is substantially similar but slightly more elongated than the adaptor plate 58. Recoil plate 52 includes the rib receiving slot 60 as part of the mounting means that slidably receives the upright rib 57 of adaptor plate 58. It is preferred that the rib 57 be a form of dovetail slide that is oriented vertically on plate 58. The rib or slide receiving slot 60 is shaped as a complementary dovetail slot. A lower end of the slot is open to receive rib 57 for elevational adjustment of the stock elevator member and an attached recoil pad 65 relative to stock 15. The dovetail configuration of the interfitting rib and slot serve to secure the attachment elements against any movement other than vertical relative to stock 15.

A lock means 62 is provided to firmly secure plates 52 and 58 against relative movement. It is comprised of a simple set screw such as that shown at 41*a*. Set screw 41*a* is threadably engaged within an aperture situated between a bottom end 63 of plate 52 and the bottom 64 of a recoil pad 65. The set screw 41*a* is therefore accessible for quick field adjustment of the attachment 50 relative to the stock 15. It operates to selectively bind the walls of the dovetail slot against the dovetail rib, firmly anchoring the recoil pad in position.

The recoil pad 65 may be of a standard rubberized impact absorbing pad that is affixed by known methods to recoil plate 52. A top 66 of the pad is positioned in alignment with an upper end 68 of the recoil plate 52. An upper curved surface 67 of the stock elevator member 53 is also substantially horizontally aligned with the top of the recoil pad 66 and recoil plate 52. The combined surfaces present a "comb" and butt plate configuration that is similar to standard gunstock configurations with the exception that this assembly is elevated and is elevationally adjustable relative to the associated gunstock.

It may be understood since the recoil pad 65 is elevated from the stock butt plate 19, that the line of recoil impact is lowered. In fact, it is desirable to lower the point of recoil impact. By this arrangement, the contact point of the recoil pad with the shooter's shoulder and the lower line of recoil force form a resultant force that tends to counteract the normal tendency for a muzzle to jump upwardly upon discharge. In addition, although the total recoil impact is the same, it is directed more toward the center of mass of the shooter and is therefore more easily absorbed. The result is that a recoil is not felt by the shooter to be as sharp a blow as would be normally expected. This produces the additional advantage of reducing the tendency of the user to "flinch" prior to discharging the weapon.

I have found from experimentation that the present attachment in some cases actually improves the balance of the associated firearm. In fact, the "swing" during trapshooting may be somewhat improved through the slightly altered balance arrangement. The stock elevator member 53, when properly positioned, prevents the shooter from lowering his head too far. His field of vision is thereby maintained. Also, the time is saved that would normally have been used to lower the head, then elevate it to a more correct position. The time gained allows more time for aiming and firing. Actual experiments in trapshooting conditions have resulted in considerably higher scores due to the above improved features.

It is pointed out that the above description and attached drawings are presented merely as examples of a preferred form of the present invention. Neither the description or the drawings are to be taken as restrictions upon the scope of my invention which is set forth only by the following claims.

What I claim is:

1. A gunstock elevator attachment for a rifle or shotgun having a stock with a butt plate and a comb extending forwardly from the butt plate, said elevator attachment comprising:
   - a recoil plate;
   - a stock elevator member on the recoil plate extending forwardly therefrom;
   - said stock elevator having a concave comb receiving surface adapted to engage the comb of an associated shotgun or rifle; and
   - mounting means for adjustably securing the recoil plate to the butt plate of a shotgun or rifle with the stock elevator member overlying the comb of the shotgun or rifle.

2. The gunstock elevator attachment as defined by claim 1 wherein the mounting means is comprised of:
   - a rib member adapted to be securely mounted to the butt of a shotgun or rifle;
   - a rib receiving slot on the recoil plate for engagement with the rib member; and
   - means for selectively locking the rib member and the rib receiving slot together.

3. The gunstock elevator attachment as defined by claim 2 wherein the rib member is an upright dovetail slide adapted to be mounted in a vertical orientation on the butt plate of a rifle or shotgun; and wherein the rib receiving slot is an open dovetail slot formed in the recoil plate for slidaby receiving the upright dovetail slide.

4. The gunstock elevator attachment as defined by claim 2 wherein the rib member is located on an adaptor plate of configuration complementary to an associated gunstock butt plate and includes mounting screws for securing the plate and rib member to the gunstock butt plate.

5. The gunstock elevator attachment as defined by claim 1 wherein the recoil plate includes an upper end adjacent the stock elevator member and a lower end; and further comprising:
   - a recoil pad mounted to the recoil plate and having a top end adjacent the upper end of the recoil plate and a bottom end spaced upwardly of the lower end of the recoil plate.

6. The gunstock elevator attachment as defined by claim 5 further comprising a set screw threadably engaged with the recoil plate between the bottom end of the recoil pad and lower end of the recoil plate; and
   - wherein the mounting means includes a rib member adapted to be mounted in an upright condition to the butt plate of a rifle or shotgun, and a rib receiving slot formed in the recoil plate for slidably receiving the dovetail slide;
   - said set screw being in open communication with the rib receiving slot and adapted to be tightened against the rib member to thereby secure the rib member relative to the rib receiving member.

7. The gunstock elevator attachment as defined by claim 6 wherein the rib member is located on an adaptor plate of configuration complementary to an associated gunstock butt plate and includes mounting screws for securing the plate and rib member to the gunstock butt plate.

8. The gunstock elevator attachment as defined by claim 1 wherein the recoil plate and stock elevator member are elevationally adjustable relative to the comb of an associated rifle or shotgun and further comprises a shim plate adapted to be fitted between the comb receiving surface of the stock elevator member and the comb of an associated gunstock.

* * * * *